US009820626B2

(12) United States Patent
Eriksson et al.

(10) Patent No.: US 9,820,626 B2
(45) Date of Patent: Nov. 21, 2017

(54) ACTUATOR MECHANISM FOR A BRUSHROLL CLEANER

(71) Applicant: Aktiebolaget Electrolux, Stockholm (SE)

(72) Inventors: Henrik Eriksson, Stockholm (SE); Brian Vines, Stockholm (SE)

(73) Assignee: Aktiebolaget Electrolux, Stockholm (SE)

( * ) Notice: Subject to any disclaimer, the term of this patent is extended or adjusted under 35 U.S.C. 154(b) by 398 days.

(21) Appl. No.: 14/467,697

(22) Filed: Aug. 25, 2014

(65) Prior Publication Data

US 2014/0359968 A1 Dec. 11, 2014

Related U.S. Application Data

(63) Continuation-in-part of application No. 13/826,630, filed on Mar. 14, 2013, now Pat. No. 9,295,364, (Continued)

(51) Int. Cl.
*A47L 5/00* (2006.01)
*A47L 11/32* (2006.01)
(Continued)

(52) U.S. Cl.
CPC ..... *A47L 11/4041* (2013.01); *A46B 13/006* (2013.01); *A47L 9/0477* (2013.01); *A47L 9/0494* (2013.01)

(58) Field of Classification Search
CPC ..... A47L 9/2831; A47L 9/2889; A46B 17/06
(Continued)

(56) References Cited

U.S. PATENT DOCUMENTS 804,213 A 11/1905 Chaplin
969,441 A 9/1910 Backer
(Continued)

FOREIGN PATENT DOCUMENTS

CA 2466000 5/2003
CN 1457742 11/2003
(Continued)

OTHER PUBLICATIONS

Notice of Allowance dated Apr. 24, 2015 for U.S. Appl. No. 13/838,035.
(Continued)

*Primary Examiner* — Bryan R Muller
(74) *Attorney, Agent, or Firm* — RatnerPrestia

(57) ABSTRACT

A vacuum cleaner head having a housing, supports extending downward from the housing to a support point, a suction opening, an agitator chamber above and in fluid communication with the suction opening, an agitator with a spindle rotatably mounted to the housing and one or more agitating devices projecting from the spindle, a cleaning member movably mounted to the housing to move to a position where it engages the agitator to remove debris from the agitator during rotation of the agitator, and a pedal connected to the housing and movable to a position to place the cleaning member in the cleaning position. The pedal has an activation surface configured to receive an activation force from an operator, and the activation surface is configured such that application of the activation force on the pedal generates a moment force to bias the agitator away from the downward direction.

16 Claims, 6 Drawing Sheets

Related U.S. Application Data which is a continuation of application No. 12/405,761, filed on Mar. 17, 2009, now Pat. No. 8,601,643.

(60) Provisional application No. 61/037,167, filed on Mar. 17, 2008.

(51) Int. Cl.

| | |
|---|---|
| ***A47L 11/40*** | (2006.01) |
| ***A46B 13/00*** | (2006.01) |
| ***A47L 9/04*** | (2006.01) |

(58) Field of Classification Search

USPC ..... 15/319, 48

See application file for complete search history.

(56) References Cited

U.S. PATENT DOCUMENTS 1,231,077 A 6/1917 Scheffler
1,268,963 A 6/1918 Gray
1,412,420 A 4/1922 Polansky
1,757,461 A 5/1930 Losey
1,813,325 A 7/1931 Smith
1,820,350 A 8/1931 Dance
1,907,692 A 5/1933 White
1,965,614 A 7/1934 Sellers
1,999,696 A 4/1935 Kitto
2,032,345 A 3/1936 Cranon
2,625,698 A 1/1953 De Kadt
2,642,601 A 6/1953 Saffioti
2,642,617 A 6/1953 Lilly
2,663,045 A 12/1953 Conway
2,733,000 A 1/1956 Sparklin
2,741,785 A 4/1956 Siebert
2,789,306 A 4/1957 Kath
2,904,818 A 9/1959 Sheahan
2,960,714 A 11/1960 Senne
2,975,450 A 3/1961 Williams
3,268,936 A 8/1966 Fukuba
3,470,575 A 10/1969 Larson
3,536,977 A 10/1970 Porter
3,683,444 A 8/1972 Schaefer
3,722,018 A 3/1973 Fisher
3,862,467 A 1/1975 Krickovich
3,863,285 A 2/1975 Hukuba
3,928,884 A 12/1975 Sutter
4,020,526 A 5/1977 Johansson
4,084,283 A 4/1978 Rosendall
4,171,554 A 10/1979 Tschudy
4,173,054 A 11/1979 Ando
4,193,710 A 3/1980 Pietrowski
4,209,872 A 7/1980 Maier
4,317,253 A 3/1982 Gut
4,352,221 A 10/1982 Revells
4,370,690 A 1/1983 Baker
4,370,777 A 2/1983 Woerwag
4,372,004 A 2/1983 Vermillion
4,373,228 A 2/1983 Dyson
4,398,231 A 8/1983 Currence
4,426,751 A 1/1984 Nordeen
4,573,235 A 3/1986 Baird, Sr.
4,654,924 A 4/1987 Getz
4,702,122 A 10/1987 Richard
4,802,254 A 2/1989 Lahndorff
4,847,944 A 7/1989 Lackner
4,875,246 A 10/1989 MacGregor
4,920,605 A 5/1990 Takashima
4,953,253 A 9/1990 Fukuda et al.
4,989,293 A 2/1991 Bashyam
5,075,922 A 12/1991 Tsuchida
5,115,538 A 5/1992 Cochran
5,121,592 A 6/1992 Jertson
5,203,047 A 4/1993 Lynn
5,243,732 A 9/1993 Koharagi
5,287,581 A 2/1994 Lo
5,394,588 A 3/1995 Kweon
5,452,490 A 9/1995 Brundula
5,482,562 A 1/1996 Abernathy
5,657,503 A 8/1997 Caruso
5,657,504 A 8/1997 Khoury
5,698,957 A 12/1997 Sowada
5,974,975 A 11/1999 Seefried
6,042,656 A 3/2000 Knutson
6,123,779 A 9/2000 Conrad
6,131,238 A 10/2000 Weber
6,170,119 B1 1/2001 Conrad
6,253,414 B1 7/2001 Bradd
6,266,838 B1 7/2001 Caruso
6,282,749 B1 9/2001 Tajima
6,286,180 B1 9/2001 Kasper
6,289,552 B1 9/2001 McCormick
6,351,872 B1 3/2002 McCormick
6,367,120 B2 4/2002 Beauchamp
6,502,277 B1 1/2003 Petersson
6,539,575 B1 4/2003 Cohen
6,539,577 B1 4/2003 Okuda
6,605,156 B1 8/2003 Clark
6,810,559 B2 11/2004 Mertes
6,883,201 B2 4/2005 Jones
6,892,420 B1 5/2005 Haan
7,143,461 B2 12/2006 Spooner
7,159,276 B2 1/2007 Omoto
7,163,568 B2 1/2007 Sepke
7,171,723 B2 2/2007 Kobayashi
7,228,593 B2 6/2007 Conrad
7,237,298 B2 7/2007 Reindle
7,243,393 B2 7/2007 Matusz
7,293,326 B2 11/2007 Hawkins
7,627,927 B2 * 12/2009 Blocker ..... A47L 9/2815 15/319
7,631,392 B1 12/2009 Meitz
7,731,618 B2 6/2010 Burlington
8,087,117 B2 1/2012 Kapoor
8,418,303 B2 4/2013 Kapoor
8,567,009 B2 10/2013 Krebs
8,601,643 B2 12/2013 Eriksson
8,671,515 B2 3/2014 Eriksson
9,072,416 B2 * 7/2015 Kowalski ..... A47L 9/0477
9,186,030 B2 11/2015 Jung
9,314,140 B2 4/2016 Eriksson
2002/0007528 A1 1/2002 Beauchamp
2004/0172769 A1 9/2004 Giddings
2004/0181888 A1 9/2004 Tawara
2004/0244140 A1 12/2004 Joo
2005/0015916 A1 1/2005 Orubor
2005/0015922 A1 1/2005 Lim
2005/0091788 A1 5/2005 Forsberg
2006/0000053 A1 1/2006 Lim
2006/0037170 A1 2/2006 Shimizu
2006/0162121 A1 7/2006 Naito
2006/0272122 A1 12/2006 Butler
2006/0288517 A1 12/2006 Oh
2007/0079474 A1 4/2007 Min
2008/0052846 A1 3/2008 Kapoor
2008/0289141 A1 11/2008 Oh et al.
2009/0000057 A1 1/2009 Yoo
2009/0100636 A1 4/2009 Sohn
2009/0229075 A1 * 9/2009 Eriksson ..... A46B 13/006 15/383
2010/0107359 A1 5/2010 Yoo
2010/0205768 A1 8/2010 Oh
2010/0287717 A1 11/2010 Jang
2010/0313912 A1 12/2010 Han
2011/0035900 A1 2/2011 Chae
2012/0013907 A1 1/2012 Jung
2012/0124769 A1 5/2012 Krebs
2013/0007982 A1 * 1/2013 Yun ..... A47L 9/0477 15/347
2013/0008469 A1 1/2013 Yun
2013/0042429 A1 2/2013 Misumi
2013/0055522 A1 3/2013 Hawkins
2013/0192021 A1 8/2013 Eriksson
2013/0192022 A1 8/2013 Eriksson
2013/0192023 A1 8/2013 Eriksson

(56) References Cited

U.S. PATENT DOCUMENTS

| | | | | |
|---|---|---|---|---|
| 2013/0192024 | A1 | 8/2013 | Eriksson | |
| 2013/0198995 | A1* | 8/2013 | Eriksson | A47L 9/0477 15/383 |
| 2014/0259521 | A1* | 9/2014 | Kowalski | A47L 9/0477 15/383 |
| 2014/0304941 | A1 | 10/2014 | Eriksson | |
| 2014/0331446 | A1* | 11/2014 | Eriksson | A46B 13/006 15/383 |
| 2014/0352104 | A1 | 12/2014 | Eriksson | |
| 2014/0366300 | A1 | 12/2014 | Eriksson | |
| 2016/0015233 | A1 | 1/2016 | Uphoff | |

FOREIGN PATENT DOCUMENTS

| | | |
|---|---|---|
| CN | 1593320 | 3/2005 |
| CN | 2746989 | 12/2005 |
| CN | 1816300 | 8/2006 |
| CN | 1816301 | 8/2006 |
| CN | 1883354 | 12/2006 |
| CN | 101310666 | 11/2008 |
| CN | 101686783 | 3/2010 |
| CN | 101984742 | 3/2011 |
| CN | 102334943 | 2/2012 |
| CN | 102462450 | 5/2012 |
| DE | 102010017211 | 12/2011 |
| DE | 102010017258 | 12/2011 |
| EP | 0649625 | 4/1995 |
| EP | 1415583 | 5/2004 |
| EP | 1442693 | 8/2004 |
| EP | 1642520 | 4/2006 |
| EP | 1994869 | 11/2008 |
| EP | 2253258 | 11/2010 |
| EP | 2273906 | 1/2011 |
| EP | 2543301 | 1/2013 |
| FR | 1068296 | 6/1954 |
| FR | 2855742 | 12/2004 |
| GB | 2000963 | 1/1979 |
| GB | 2231778 | 11/1990 |
| JP | 4944560 | 4/1974 |
| JP | 50114057 | 9/1975 |
| JP | 61062426 | 3/1986 |
| JP | 05095868 | 4/1993 |
| JP | 5095868 | 4/1993 |
| JP | 05103740 | 4/1993 |
| JP | 5305044 | 11/1993 |
| JP | 0686743 | 3/1994 |
| JP | 6086743 | 3/1994 |
| JP | 0856877 | 3/1996 |
| JP | 08056877 | 3/1996 |
| JP | 08289862 | 11/1996 |
| JP | 2002165731 | 6/2002 |
| JP | 2003047577 | 2/2003 |
| JP | 2003125991 | 5/2003 |
| JP | 2005160578 | 6/2005 |
| JP | 2005211426 | 8/2005 |
| JP | 2008000382 | 1/2008 |
| JP | 2008188319 | 8/2008 |
| JP | 2008278947 | 11/2008 |
| JP | 2009022644 A | 2/2009 |
| WO | 9210967 | 7/1992 |
| WO | 2008099583 | 8/2008 |
| WO | 2009117383 | 9/2009 |
| WO | 2010041184 | 4/2010 |
| WO | 2013060365 | 5/2013 |
| WO | 2013060879 | 5/2013 |
| WO | 2013060880 | 5/2013 |
| WO | 2013113395 | 8/2013 |
| WO | 2014094869 | 6/2014 |
| WO | 2014177216 | 11/2014 |

OTHER PUBLICATIONS

Entire patent prosecution history of U.S. Appl. No. 14/651,059, filed Jun. 10, 2015, entitled, "Cleaning Arrangement for a Rotatable Member of a Vacuum Cleaner, Cleaner Nozzle, Vacuum Cleaner and Cleaning Unit."

Entire patent prosecution history of U.S. Appl. No. 14/702,034, filed May 1, 2015, entitled, "Cleaning Nozzle for a Vacuum Cleaner."

Entire patent prosecution history of U.S. Appl. No. 14/730,833, filed Jun. 4, 2015, entitled, "Vacuum Cleaner Agitator Cleaner With Agitator Lifting Mechanism."

International Search Report for International Application No. PCT/EP2012/076620 dated Jul. 23, 2013.

Non-Final Office Action dated Apr. 16, 2015 for U.S. Appl. No. 14/354,460.

Office Action dated May 20, 2015 for U.S. Appl. No. 13/835,691.

Notice of Allowance dated Jun. 24, 2015 for U.S. Appl. No. 13/826,855.

Office Action dated Jul. 7, 2015 for U.S. Appl. No. 13/826,934.

Chinese Office Action dated Jul. 1, 2015 for Chinese Application No. 201310485330.X, including English language translation.

Chinese Office Action dated Jul. 14, 2015 for Chinese Application No. 201310479507.5, including English language translation.

Chinese Office Action dated Jul. 3, 2015 for Chinese Application No. 201310485943.3, including English language translation.

Chinese Office Action dated Jun. 30, 2015 for Chinese Application No. 201310485447.8, including English language translation.

International Preliminary Report on Patentability for International Application No. PCT/IB2014/001050 dated Sep. 15, 2015.

International Preliminary Report on Patentability for International Application No. PCT/IB2014/001256 dated Sep. 15, 2015.

Notice of Allowance dated Sep. 10, 2015 for U.S. Appl. No. 13/826,630.

Notice of Allowance dated Oct. 9, 2015 for U.S. Appl. No. 14/354,460.

Notice of Allowance dated Oct. 16, 2015 for U.S. Appl. No. 13/835,691.

Final Office Action dated Nov. 30, 2015 for U.S. Appl. No. 13/826,934.

Notice of Allowance dated Dec. 31, 2015 for U.S. Appl. No. 13/826,630.

Notice of Allowance dated Dec. 15, 2015 for U.S. Appl. No. 13/835,691.

Notice of Allowance dated Dec. 23, 2015 for U.S. Appl. No. 14/354,460.

International Search Report dated Dec. 10, 2013 for International Application No. PCT/EP2013059148.

International Search Report and Written Opinion for International Application No. PCT/IB2015/001873, dated Feb. 4, 2016.

Notice of Allowance dated Feb. 11, 2016 for U.S. Appl. No. 13/826,934.

Japanese Office Action dated Dec. 15, 2015 for Japanese Application No. 2014-555092 with translation.

Chinese Office Action dated Nov. 27, 2015 for Chinese Application No. 201280068532.8 with translation.

Non Final Office Action for U.S. Appl. No. 14/730,833, dated May 19, 2016. (pp. 1-31).

Chinese Office Action dated Apr. 1, 2016 for Chinese Application No. 201280076273.3 with translation. (pp. 1-17).

Chinese Office Action for Chinese Application No. 201310485447.8, dated Feb. 14, 2016. (pp. 1-5).

Chinese Office Action dated Feb. 29, 2016 for Chinese Application No. 201310485330.X with translation. (pp. 1-9).

Non Final Office Action for U.S. Appl. No. 14/354,449, dated Aug. 11, 2016, 45 pages.

Japanese Office Action for Japanese Application No. 2014-537645, dated Jun. 14, 2016 with translation, 5 pages.

Japanese Office Action for Japanese Application No. 2014-555092, dated May 24. 2016 with translation, 5 pages.

Non Final Office Action for U.S. Appl. No. 14/888,275, dated Dec. 2, 2016, 24 pages.

Notice of Allowance for U.S. Appl. No. 14/730,833, dated Dec. 2, 2016, 14 pages.

Notice of Allowance for U.S. Appl. No. 14/354,449, dated Nov. 30, 2016, 10 pages.

(56) References Cited

OTHER PUBLICATIONS

Japanese Office Action for Japanese Application No. 2015548227, dated Oct. 14, 2016, 5 pages.
Chinese Office Action for Application No. 201280058003.X, dated Oct. 9, 2016, 18 pages.
International Search Report for International Application No. PCT/US2009/037348 dated May 14, 2009.
International Search Report for PCT International Application No. PCT/EP2011/068743 dated Jun. 14, 2012.
International Search Report for PCT International Application No. PCT/EP2012/051773 dated Sep. 17, 2012.
International Search Report for PCT International Application No. PCT/EP2012/071318 dated Jan. 3, 2013.
International Search Report for PCT International Application No. PCT/EP2012/071319 dated Dec. 11, 2012.
Office Action for CN 200980110915.5 (with English Translation), The State Intellectual Property Office of China, dated Feb. 4, 2013.
Supplemental European Search Report for Application No. EP 09 72 1677, dated Oct. 30, 2012.
Entire patent prosecution history of U.S. Appl. No. 13/826,630, filed Mar. 14, 2013, entitled, "Brushroll Cleaning Feature With Spaced Brushes and Friction Surfaces to Prevent Contact."
Entire patent prosecution history of U.S. Appl. No. 13/826,855, filed Mar. 14, 2013, entitled, "Brushroll Cleaning Feature With Overload Protection During Cleaning."
Entire patent prosecution history of U.S. Appl. No. 13/826,934, filed Mar. 14, 2013, entitled, "Automated Brushroll Cleaning."
Entire patent prosecution history of U.S. Appl. No. 13/835,691, filed Mar. 15, 2013, entitled, "Vacuum Cleaner Agitator Cleaner With Power Control."
Entire patent prosecution history of U.S. Appl. No. 14/462,956, filed Aug. 19, 2014, entitled, "Vacuum Cleaner Brushroll Cleaner Configuration."
Entire patent prosecution history of U.S. Appl. No. 13/838,035, filed Mar. 15, 2013, entitled, "Vacuum Cleaner Agitator Cleaner With Brushroll Lifting Mechanism."
Entire patent prosecution history of U.S. Appl. No. 13/826,400, filed Mar. 14, 2013, entitled, "Brushroll Cleaning Feature With Resilient Linkage to Regulate User-Applied Force," now U.S. Pat. No. 8,671,515, issued Mar. 18, 2014.
Entire patent prosecution history of U.S. Appl. No. 12/405,761, filed Mar. 17, 2009, entitled, "Agitator With Cleaning Features," now U.S. Pat. No. 8,601,643, issued Dec. 10, 2013.
Entire patent prosecution history of U.S. Appl. No. 14/374,119, filed Aug. 25, 2014, entitled, "Cleaning Arrangement for a Nozzle of a Vacuum Cleaner."
Entire patent prosecution history of U.S. Appl. No. 14/354,460, filed Jun. 19, 2014, entitled, "Cleaning Nozzle for a Vacuum Cleaner."
Entire patent prosecution history of U.S. Appl. No. 14/354,449, filed Apr. 25, 2014, entitled, "Cleaning Nozzle for a Vacuum Cleaner."
Entire patent prosecution history of U.S. Appl. No. 14/354,466, filed Apr. 25, 2014, entitled, "Cleaning Nozzle for a Vacuum Cleaner."
International Search Report and Written Opinion for International Application No. PCT/IB2014/001050, dated Oct. 28, 2014.
International Search Report and Written Opinion for International Application No. PCT/IB2014/001256, dated Oct. 28, 2014.
International Preliminary Report on Patentability for International Application No. PCT/IB2015/001873, dated Feb. 28, 2017.
Non Final Office Action for U.S. Appl. No. 14/354,466, dated Jan. 27, 2017, 10 pages.
Non Final Office Action for U.S. Appl. No. 14/462,956, dated Feb. 22, 2017, 13 pages.
Chinese Office Action for Chinese Application No. 201280058003.X, dated Apr. 6, 2017 with translation, 17 pages.
Final Office Action for U.S. Appl. No. 14/354,466, dated May 12, 2017, 13 pages.
Notice of Allowance for U.S. Appl. No. 14/354,449, dated Aug. 11, 2017, 9 pages.
Notice of Allowance for U.S. Appl. No. 14/354,466, dated Aug. 1, 2017, 8 pages.
Notice of Allowance for U.S. Appl. No. 14/462,956, dated Jul. 19, 2017, 10 pages.
Non Final Office Action for U.S. Appl. No. 14/374,119, dated Jun. 27, 2017, 8 pages.
Non Final Office Action for U.S. Appl. No. 14/651,059, dated Jul. 17, 2017, 8 pages.
Korean Office Action for Korean Application No. 10-2014-7013892, dated Jun. 30, 2017 with translation, 16 pages.
Non-Final Office Action for U.S. Appl. No. 14/702,034, dated Oct. 16, 2017, 11 pages.

* cited by examiner

ACTUATOR MECHANISM FOR A BRUSHROLL CLEANER

BACKGROUND

It has been found that rotating agitators used in vacuum cleaners, floor sweepers, and the like, can collect a significant amount of various kinds of dirt and debris on the agitator itself. For example, the debris may include human and animal hairs, strings, threads, carpet fibers and other elongated fibers that wrap around or otherwise cling to the agitator. It has also been found that accumulated debris can reduce the performance of the agitator in a variety of ways. For example, debris may cover the agitation bristles and diminish the agitator's ability to agitate a surface. Further, debris on the agitator may impede the rotation of the agitator by wrapping around the axle or by creating additional friction with the cleaning head. If not removed, such debris can also accumulate on or migrate to the ends of the agitator and enter the bearing areas where it may cause binding, remove bearing lubrication, or otherwise generate high friction, excessive heat, or other undesirable conditions that can damage the bearings or mounting structure. In addition, debris collected on the agitator may create an imbalance in the agitator that may result in sound and/or vibrations when the agitator rotates.

Debris that has collected on an agitator is often difficult to remove because it has wrapped tightly around the agitator and intertwined with the bristles. Users of a cleaning device often must invert the device and remove the debris with manual tools such as knives, scissors or other implements. Manual removal can be unsanitary, time consuming, and, if the user fails to follow instructions to deactivate the vacuum, may expose the user to contact with a moving agitator.

Some known devices use mechanisms and features to facilitate removing elongated fibers, such as string and hair, that may become wrapped around an agitator during use. For example, some agitators are provided with integral grooves that allow access by a pair of scissors or a knife blade to manually cut the fiber. Other cleaning devices use comb-like mechanisms to attempt to remove fibers. One example is shown in U.S. Pat. No. 2,960,714, which is incorporated herein by reference.

It is also known to provide features to clean rotating agitators. For example, U.S. Pat. No. 8,601,643 ("the '643 patent"), which is incorporated herein by reference, describes a variety of agitator cleaning devices that remove fibers that are wound around the agitator. In the device in the '643 patent, the agitator is provided with a raised support surface that provides a firm backing against which the blade presses to pinch and cut the fibers. Devices such as the one in the '643 patent have been found to be effective for simple and durable user-friendly cleaning. Other agitator cleaning devices include those shown in U.S. Pat. Nos. 2,960,714; 2,642,617; and 804,213, which are also incorporated herein by reference.

While various features of vacuum cleaner agitators and agitator cleaning devices are known, there still exists a need to provide alternatives, modifications, and improvements to such devices.

SUMMARY

In one exemplary embodiment, there is provided a vacuum cleaner head having a housing extending along a longitudinal direction from a first end of the housing to a second end of the housing, one or more supports extending in a downward direction that is perpendicular to the longitudinal direction from the housing to a first support point located proximate to the first end of the housing, a and suction opening provided through the housing and facing in the downward direction, an agitator chamber located above and in fluid communication with the suction opening. The vacuum cleaner head also includes an agitator having a spindle rotatably mounted to the housing to rotate about a rotation axis that extends through the agitator chamber, and one or more agitating devices projecting from the spindle to a first radial height. A cleaning member is movably mounted to the housing to move between a first cleaning member position in which the cleaning member does not engage the agitator, and a second cleaning member position in which the cleaning member engages the agitator to remove debris from the agitator during rotation of the agitator. A pedal is connected to the housing and movable between a first pedal position in which the pedal does not place the cleaning member in the second cleaning member position, and a second pedal position in which the pedal places the cleaning member in the second cleaning member position. The pedal has an activation surface configured to receive an activation force from an operator to move the pedal from the first pedal position to the second pedal position. The activation surface is configured such that application of the activation force on the pedal generates a moment force to bias the agitator away from the downward direction.

Other embodiments may include additional or alternative features. For example, the vacuum cleaner head may include an anti-rotation support located at the first end of the housing and positioned to limit how far the housing can rotate about the first support point upon application of the activation force. As another example, the pedal may be operatively connected to the cleaning member by a linkage, such as a linear slide configured to convert a first rotational movement of the pedal about a first pivot into a second rotational movement of the cleaning member about a second pivot to move the cleaning member from the first cleaning member position to the second cleaning member position.

It will be appreciated that this Summary is not intended to limit the claimed invention in any way.

BRIEF DESCRIPTION OF THE DRAWINGS

A better understanding of the exemplary embodiments may be understood by reference to the attached drawings, in which like reference numbers designate like parts. The drawings are exemplary, and not intended to limit the claims in any way.

BRIEF DESCRIPTION OF EMBODIMENTS

The present invention is directed to agitator cleaning devices, and particularly to devices that remove material from the agitator as the agitator rotates. It has been determined that such agitator cleaning devices typically are used while the vacuum cleaner (or other floor cleaning device to which the agitator is attached) remains stationary in one location on the floor. Thus, the rotating agitator may remain in contact with a single spot on the floor during the entire agitator cleaning process. This can lead to excessive abrasion or even burning or melting of the underlying floor, particularly where the floor comprises a soft or delicate carpet fiber.

It has been found that this problem can be exacerbated by certain mechanisms that are used to operate the agitator cleaner. For example, some devices use a foot-operated pedal located approximately above the agitator. In these cases, a downward force on the operation pedal may also generate a force that presses the agitator against the floor. This additional force can increase the likelihood that the rotating agitator will damage the underlying floor.

Figure 1:
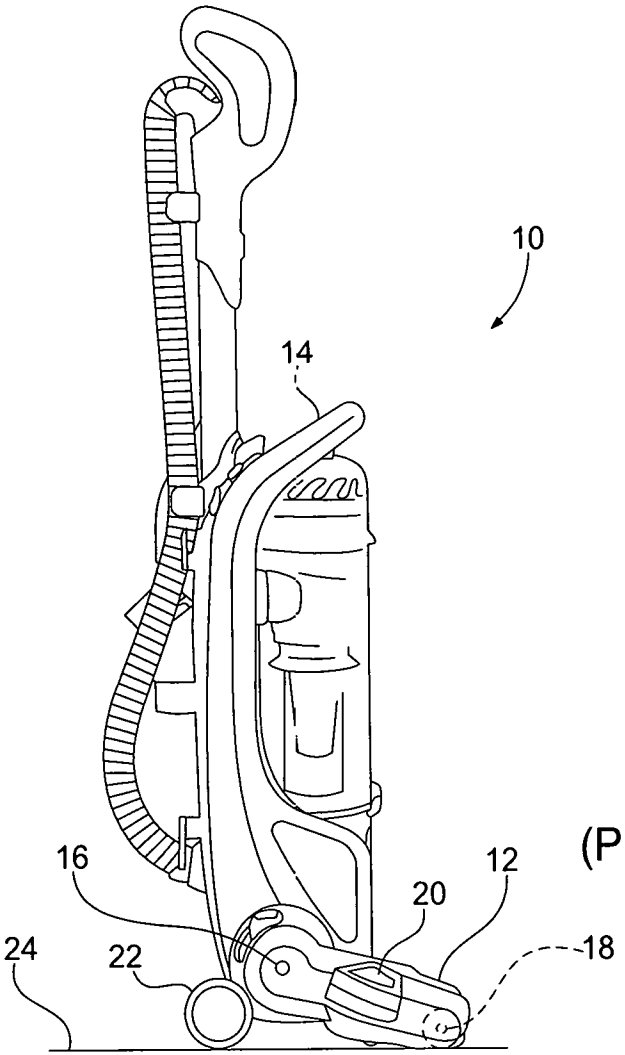
FIG. 1 (PRIOR ART)
FIG. 1 is an example of a prior art vacuum cleaner.

FIG. 1 shows a side elevation view of a typical prior art vacuum cleaner 10 that is subject to the foregoing problem. The vacuum cleaner 10 includes a base 12, a handle 14, and a pivot 16 that connects the base 12 to the handle 14 to allow relative rotation between the base 12 and handle 14. The base 12 includes a brushroll 18 and a brushroll cleaning mechanism (not shown) that is activated by a pedal 20 located on the base 12. The pedal 20 is located between the rear wheel 22 and the brushroll 18. As such, a downward force $F_1$ applied on the pedal 20 to activate the brushroll cleaning mechanism also tends to press the agitator 18 more firmly into the underlying floor 24.

To counteract the possibility that the force $F_1$ will damage the underlying carpet, the vacuum cleaner 10 may be equipped with a mechanism to lift the agitator 18 away from the floor 24 whenever the vacuum cleaner 10 is placed in the illustrated upright position, or whenever the brushroll cleaning mechanism is operated. Such lifting devices are known and illustrated, by way of non-limiting examples, in U.S. Pat. No. 4,446,594 and U.S. application Ser. No. 13/838,035, which are incorporated herein by reference. Other measures also may be taken, such as limiting the amount of time that the brush motor continues to operate during the cleaning operation, or modifying the agitator bristles to reduce the possibility that they can damage the floor. However, such approaches may have certain drawbacks. For example, such solutions may add cost and complexity to the device.

Another example of a device that could suffer from the foregoing problem of increased likelihood of floor damage is the device shown in the '643 patent. For example, the embodiment of FIG. 12 of the '643 patent has an agitator cleaning device located directly above the agitator, and a force to push down on the cleaning device could press the agitator into the floor and potentially damage the floor. The embodiment of FIGS. 11*a*-11*c* of the '643 patent also may suffer from an increased likelihood of floor damage caused by a downward force on the pedal generating an increased downward force on the agitator, depending on the locations of the wheels or other supporting structures (which are not illustrated in FIGS. 11*a*-11*c*). For example, if the arrangement in FIG. 12 were used in the vacuum cleaner shown in FIG. 1, the operation pedal would be located at least partially in front of the rear wheel 22, resulting in the problem described above.

It has been determined that the likelihood of experiencing excessive downward force on the agitator during the agitator cleaning operation can be mitigated, and possibly eliminated, by providing an agitator cleaning mechanism that generates a neutral (i.e., essentially zero) or negative (i.e., lifting) force on the agitator during agitator cleaning. Exemplary embodiments of such an agitator cleaning mechanism are now described in detail.

Figure 2:
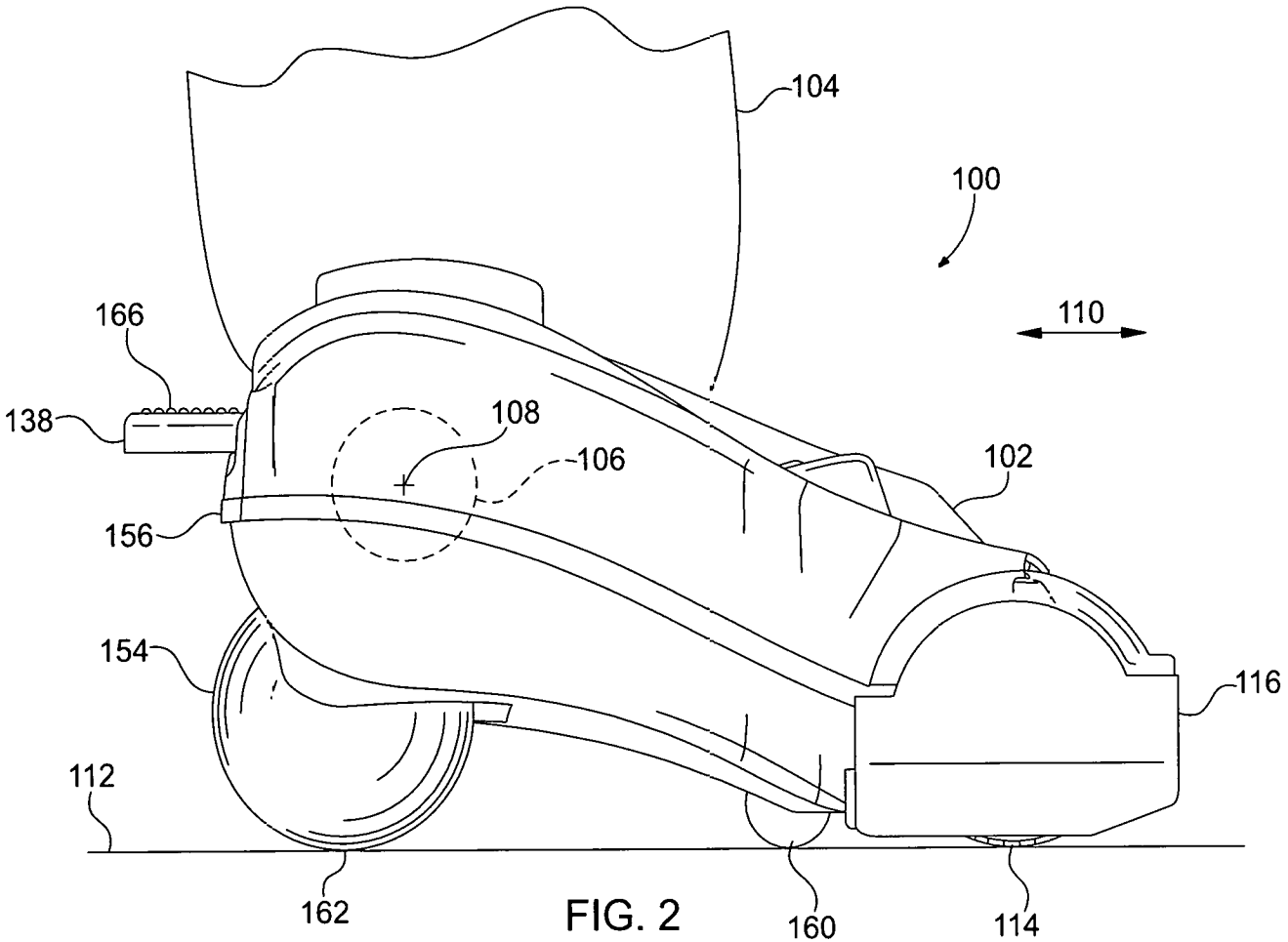
FIG. 2 is a side elevation view of the lower parts of an exemplary upright vacuum cleaner.

FIG. 2 shows a side elevation view of the lower part of an exemplary upright vacuum cleaner 100. The vacuum cleaner 100 includes a base 102, a handle 104, and a pivot 106 that connects the base 102 to the handle 104 to allow relative rotation between the base 102 and handle 104 about a handle pivot axis 108. The base 102 and/or handle 104 may be formed as one or more housings that hold the operative components of the vacuum cleaner, such as the suction fan, fan motor, suction passages, dirt separator (cyclone, bag filter, panel filter, etc.), and so on, as known in the art. Examples of upright vacuum cleaners and their component parts are shown in U.S. Pat. No. 7,293,326 and U.S. application Ser. Nos. 11/771,838 and 13/712,512, which are incorporated herein by reference.

The base 102 extends in a longitudinal direction 110 that is parallel to the underlying floor 112, and aligned with the fore-aft direction in which the base 102 is generally moved during floor cleaning. The pivot 106 may comprise a single-axis joint with a pivot axis 108 that is perpendicular to the longitudinal direction 110 and parallel to the floor 112. This direction is referred to herein as the lateral direction. Other alternatives may use multiple-axis joints, which rotate about two or more separate pivot axes, as known in the art.

Figure 3:
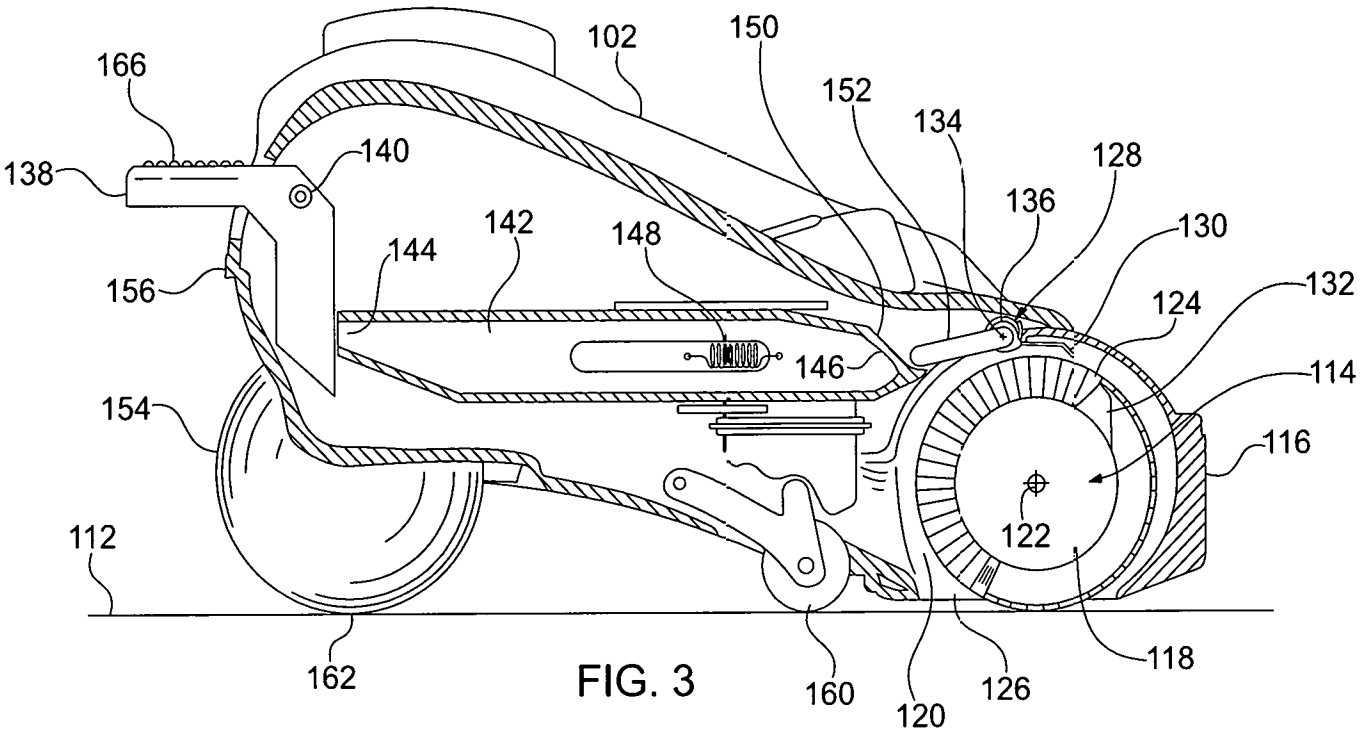
FIG. 3 is a partially cutaway view of the base of the embodiment of FIG. 2.
Figure 4:
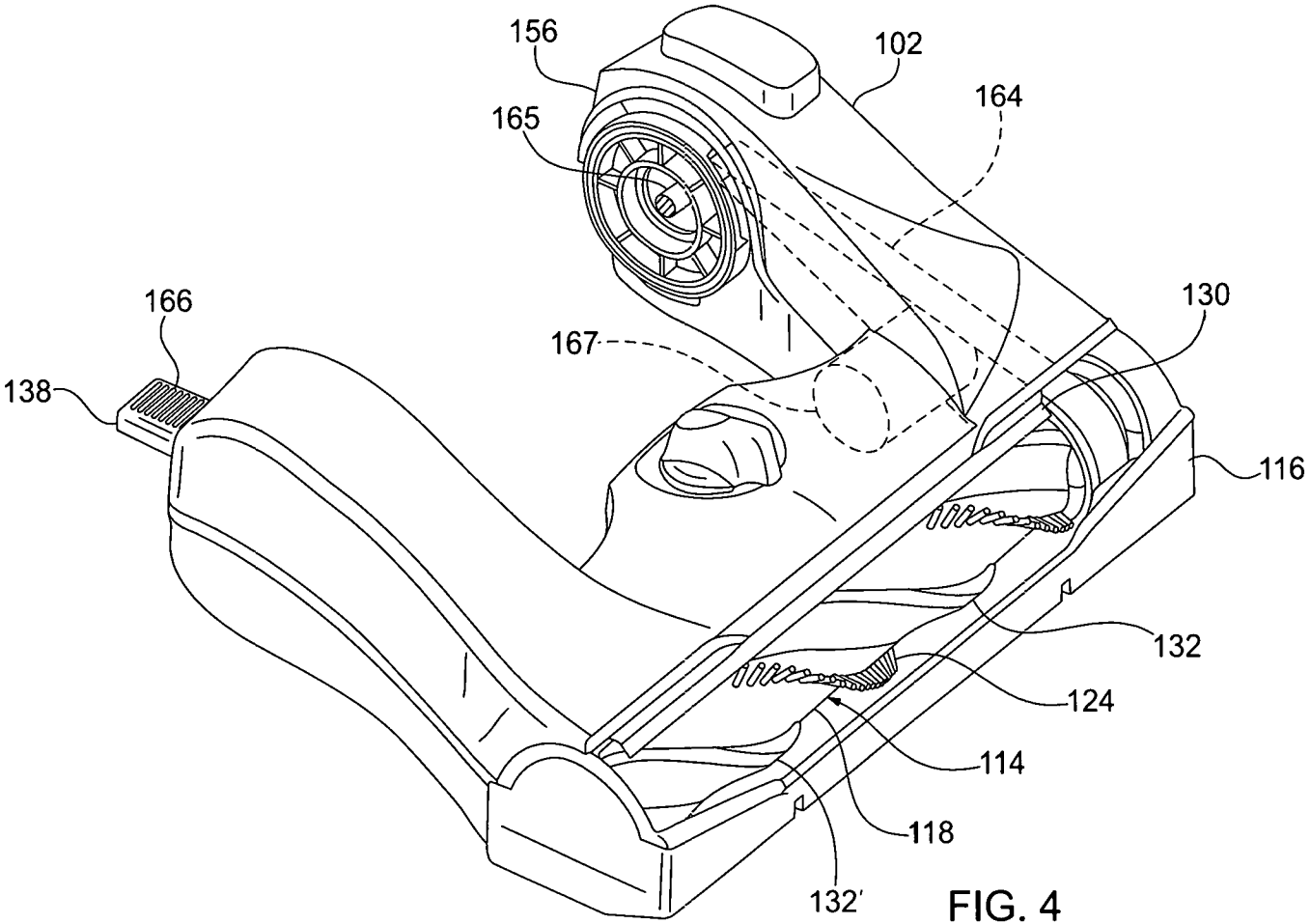
FIG. 4 is an isometric view of the vacuum cleaner base of FIG. 2.

Referring also to FIGS. 3 and 4, an agitator 114 is provided at a front end 116 of the base 102. The agitator 114 includes a spindle 118 that is mounted in an agitator chamber 120 formed inside the base 102. The spindle 118 is rotatably mounted on bearings, bushings, or the like, to rotate about an agitator rotation axis 122. The agitator rotation axis 122 preferably is parallel to the floor 112, and perpendicular to the longitudinal direction 110 (i.e., parallel to the lateral direction), but these orientations are not strictly required in all embodiments. The bottom of the agitator chamber 120 is fluidly connected to a suction opening 126 through which the operating airflow of the vacuum cleaner draws dirt during the vacuum cleaning operation. The suction opening 126 may be directly below the agitator 114, but it is also known to use one or more offset suction openings that lie in front of and/or behind the agitator 114. One or more suction hoses or internal passages are provided to connect the agitator chamber 120 to the suction fan, as known in the art.

The agitator 114 may be driven by gears, pulleys, belts, or the like, as known in the art. For example, the shown agitator 114 is driven by a belt 164 that may be powered by a spindle 165 driven by the main suction fan motor of the vacuum cleaner, or by a separate dedicated electric motor 167. Such arrangements are well-known in the art, and need not be described in more detail herein.

The agitator 114 preferably includes one or more agitating devices (bristles, flaps, etc.), such as one or more helical rows of bristles 124. The agitating devices may extend from the spindle 118 to a first radial height (i.e., a first distance, as measured in the radial direction from the agitator rotation axis 122). The first radial height preferably is sufficiently large enough that the ends of the agitating devices extend through the suction opening 126 to contact an underlying floor 112. However, some or all of the agitating devices may not extend this far. A variety of different agitating devices that extend to multiple different radial heights (e.g., a combination of two helical rows of bristles interposed between two somewhat shorter helical flaps) may be used in alternative embodiments. Furthermore, the agitator 114 may be movable relative to the base 102 to selectively retract the agitating devices so that they do not extend through the suction opening 126, as may be desirable during bare floor cleaning.

An agitator cleaning mechanism 128 is also provided in the base 102. The agitator cleaning mechanism 128 may comprise any apparatus that is used to remove dirt, fibers, or the like from the agitator 114. As one example, the agitator cleaning mechanism 128 comprises a blade 130 that is selectively movable into contact with the agitating devices (e.g., bristles 124) as the agitator 114 is rotated, in order to remove dirt and particularly wrapped fibers from the agitator 114. The blade 130 may comprise spring steel or other materials, and may have a sharpened edge. The blade 130 also may be somewhat flexible to limit the amount of force that is generated between the blade 130 and agitator 114. The blade 130 also may be formed as multiple independently-moveable blade parts that extend in parallel and may be placed end-to-end or overlapping one another. If desired, the blade 130 also may be replaced by a comb-like structure or other structures that are suitable for cleaning material from the agitator 114.

To agitator cleaning mechanism 128 also may include one or more rigid friction surfaces 132 on the agitator 114, against which the blade 130 bears to help strip away fibers. As shown in FIG. 4, the friction surfaces 132 may be formed as protrusions from the agitator spindle 118, and may be formed integrally as part of the spindle 118. The exemplary friction surfaces 132 extend a second radial height from the agitator rotation axis 122. The second radial height may be less than the first radial height of the agitating devices, and may be selected so that the friction surfaces 132 do not extend through the suction opening 126, but this is not strictly required.

The friction surfaces 132 preferably comprise one or more helical protrusions. For example, the embodiment of FIG. 4 may include one friction surface 132 formed as a helix that extends the full length of the spindle 118 (excluding mounting points, the drive belt pulley surface, and other areas where the bristles may not be present). A second raised surface 132' may be provided opposite the friction surface 132, but at a smaller radial height than the friction surface 132, so that the blade 130 does not contact the surface 132' during the agitator cleaning operation. In this case, the second surface 132' may act as a counterbalance to the friction surface 132. Alternatively, the second surface 132' may be at the same radial height as the friction surface 132, to act as a second friction surface. Other alternatives will be readily apparent to persons of ordinary skill in the art in view of the present disclosure. As some examples, friction surfaces having different (e.g., non-helical) shapes may be used, the single helical friction surface 132 can be divided into multiple parts, and the friction surfaces may be separately formed and joined to the spindle 118.

The blade 130 is mounted to the base 102, preferably at a location adjacent the agitator 114, and movable between a first position in which the blade 130 is spaced from the agitator 114, and a second position in which the blade engages the agitator 114 to clean away debris. In the second position, the blade 130 may contact the friction surface 132 at one or more locations. To provide such movement, the blade 130 may be mounted to the base 102 by a pivot 134. Alternative embodiments may use sliding mounts or other kinds of movable connections. A spring 136 may be provided to automatically return the blade 130 to the first position when agitator cleaning is not desired.

Further details of the exemplary cleaning mechanism 128 and other alternative embodiments are found in the '643 patent, and U.S. application Ser. Nos. 13/838,035; 14/357,460; 14/357,449; and 14/357,466 (as well as other references noted herein), which are incorporated herein by reference. It will be understood that the inventions described herein relate to agitator cleaning mechanisms in general, and may be used with the foregoing examples or any other kind of mechanism that selectively cleans dirt, and particularly elongated fibers like string and hair, from the agitator 114.

The agitator cleaning mechanism 128 is operated by a pedal 138 on the base 102. In the shown example, the pedal 138 is mounted on the base 102 by a pedal pivot 140, which allows the pedal 138 to rotate relative to the base 102 about a predetermined range of movement. The pivot may be replaced by sliding connections and other movable connections in other embodiments. A linkage operatively connects the pedal 138 to the blade 130. Any suitable linkage may be used. For example, the linkage may comprise a linear slide 142 that has a first end 144 adjacent the pedal 138 and a second end 146 adjacent the blade 130. The slide 142 is mounted on a track (e.g., a channel formed in the base 102) to reciprocate along a linear direction extending between the first and second ends 144, 146. A spring 148 is provided to bias the slide 142 in a direction towards the first end 144.

The first end 144 of the slide 142 is positioned and shaped to be contacted and pressed by the pedal 138 when the pedal 138 is depressed by a user. In this example, the pedal 138 is shaped as an "L", with the pivot 140 at the corner of the "L", one leg of the "L" being positioned to receive a user's foot or hand, and the other leg of the "L" abutting the first end 144 of the slide 142. The second end 146 of the slide 142 is positioned and shaped to move the blade 130 from the first position (inactive) to the second position (agitator cleaning). For example, the second end 146 may be shaped with a cam surface 150 that abuts an arm 152 that is rigidly connected to the blade 130. In this embodiment, pressing the pedal 138 downward moves the slide 142 towards the second end 146, and the cam surface 150 presses the arm 152 upwards to rotate the blade 130 downward into engagement with the agitator 114. When pressure on the pedal 138 is released, the spring 148 moves the slide 142 back towards the first end 144 and the first end 144 pushes the pedal 138 back to the inactive position, and the blade spring 136 lifts the blade 130 away from the agitator 114.

Other embodiments may use other mechanisms to operatively connect the pedal 138 to the blade 130. For example, the slide spring 148 may be removed if the blade spring 136 is sufficiently strong to return all of the parts to their inactive position when the user stops pressing the pedal 138. As another example, the cam surface 150 and arm 152 may be replaced by a pin-in-slot arrangement that provides two-way position control, so that the slide 142 pulls the blade 130 into the inactive position as it moves back towards the first end 144 (which can eliminate the need for a separate blade spring 136). The slide 142 or other parts also may include a resilient member (e.g., a compression spring) through which the force is applied, and such a resilient member can be configured to compress to allow the blade 130 to flex away from the fully-operative position in the event a large object is wrapped around the agitator 114. The blade 130 itself may be formed as the resilient member, as described in the incorporated references. Other embodiments may use other mechanisms to operate the agitator cleaning mechanism, such as multiple pivoting links, gears, belts, and the like. Other alternatives will be readily apparent to persons of ordinary skill in the art in view of the present disclosure.

Figure 5:
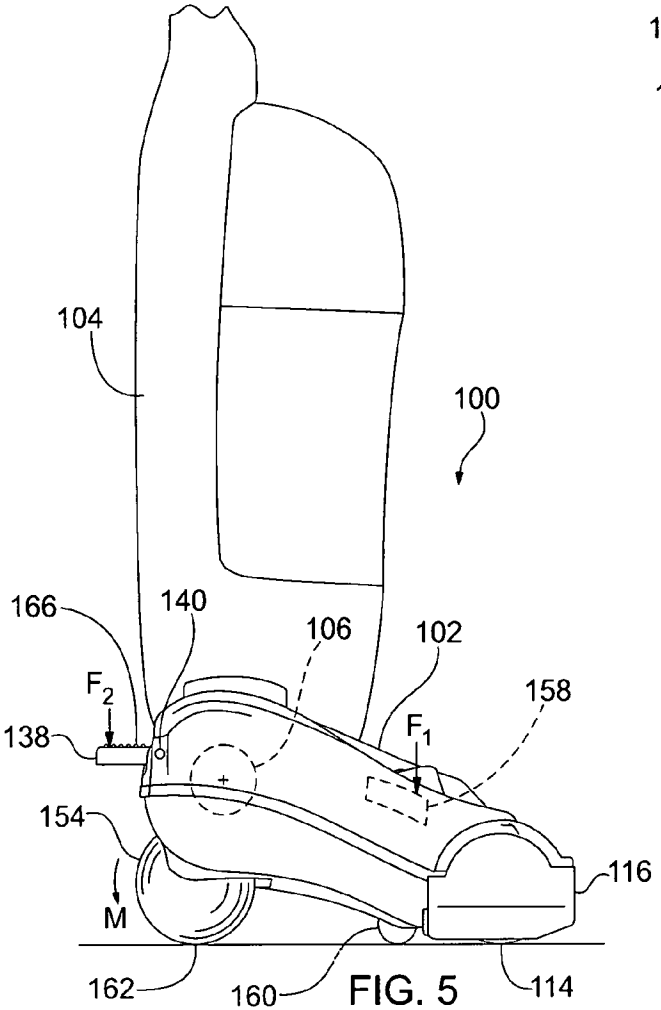
FIG. 5 is a side view of an exemplary floor cleaner showing forces associated with operation of an agitator cleaning device.

Referring now to FIG. 5, the vacuum cleaner base 102 preferably includes one or more rear supports, such as one or more rear wheels 154, located proximate to a back end 156 of the base 102. In most applications, two wheels are provided on opposite sides of a longitudinal centerline of the base 102, but vacuum cleaners may use a single rear wheel, or more than two rear wheels. The wheels 154 may fixed at a particular orientation, or mounted on swivels to allow rotation about a vertical axis (i.e., casters). The rear wheels also may be replaced by ball rollers, skids, or the like. The rear wheels 154 support at least a portion of the weight of the vacuum cleaner on the floor 112. To this end, the rear wheels 154 typically engage the floor 112 at a single rear wheel contact point 162 along the longitudinal axis 110 (i.e., each wheel 154 may have a separate physical contact location, but both contact locations typically will be at the same point along the longitudinal axis 110).

The agitator 114 is located, with respect to the longitudinal direction 110, such that it contacts the floor 112 in front of the rear wheel contact point 162. The agitator also may be located proximate to a front end 116 of the base 102. The base 102 also may include one or more front supports 160, such as wheels, skids or ball rollers, located to contact the floor 112 at a point between the rear wheel contact point 162 and the front end 116. The front supports 160 may be movable to selectively raise and lower the agitator 114 relative to the floor 112.

As noted above, it has been found that some agitator cleaning devices are configured in such a way that the force applied to activate the agitator cleaning device also tends to press the agitator 114 into the underlying floor 112 material. This increases the likelihood that the rotating agitator 114 will damage the floor 112, unless countermeasures are taken to prevent such damage. For example, FIG. 5 shows the approximate location where the agitator cleaner activation pedal 158 of the commercial product shown in FIG. 1 would be located if it were used. In this case, the pedal 158 would be located in front of the rear wheel contact point 162 with respect to the longitudinal direction 110, and oriented to receive a downward operation force $F_1$ from the user. Applying the downward operation force $F_1$ to the pedal 158 increases the downward forces generated at the agitator 114, which consequently increases the amount of friction between the rotating agitator 114 and the floor 112. This is particularly likely if the floor 112 is a carpet having relatively long pile fibers. This application of the operation force $F_1$ would increase the likelihood that the floor 112 will be damaged.

To address this problem, the pedal 138 of the exemplary embodiment is located and oriented such that the operating force applied to the pedal 138 does not press the agitator 114 into the floor 112, and may in fact reduce the existing contact force between the agitator 114 and the floor 112. Embodiments providing this arrangement may be may be configured in various ways, as explained by the following examples.

As a first example, the embodiment of FIG. 5 has the pedal 138 positioned on the opposite side of the rear wheel contact point 162 as the agitator 114 (i.e., the pedal 138 is behind the rear wheel contact point 162), and has an activation surface 166 that faces upwards to receive a generally downwards activation force $F_2$. As shown in FIG. 5, the activation force $F_2$ is oriented on an axis that passes behind the rear wheel contact point 162, and thus generates a moment force M that tends to rotate the base 102 about the rear wheel contact point 162 to lift the agitator 114 away from the floor 112. The pedal 138 and the activation surface 166 may be located entirely behind the back end 156 of the base housing, as shown in FIG. 5. However, the back end 156 of the base housing may extend behind the rear wheel contact point 162, such that the pedal 138 is not actually behind the back end 156.

In practice, the agitator 114 may not actually perceptibly move away from the floor 112, due to flexure of the pedal 138 and other parts of the linkage that joins the pedal 138 to the agitator cleaning mechanism 128, or flexure of the underlying floor 112. For example, if the base 102 is on a particularly soft floor 112, such as a very high pile rug, the activation force $F_2$ may initially generate an increased downward force across the base 102 to press the rear wheels 154 deeper into the rug, and the overall lifting effect at the agitator 114 may not be as pronounced as it would be on a harder floor surface. However, even in these cases it is expected that the activation force $F_2$ will not appreciably increase the force of contact between the agitator 114 and the floor 112, and is more likely to decrease the force of such contact.

The activation force $F_2$ in the embodiment of FIG. 4 preferably is generally vertical (i.e., perpendicular to the longitudinal direction 110) and does not pass in front of the rear wheel contact point 162. While in practice it is impossible to control exactly how a consumer will apply the activation force $F_2$, the direction of the activation force $F_2$ can be somewhat controlled by providing a distinct upward-facing activation surface 166 that is shaped to make the proper operation readily apparent. The activation surface 166 also could be provided as a button that protrudes from or is next to a fixed horizontal surface, making it more difficult to press the button sideways instead of down. Also, the activation surface 166 can be located at greater distances along the longitudinal axis 110 behind the rear wheel contact point 162 to reduce the possibility that the activation force $F_2$ will be oriented in such a way to potentially increase the force between the floor 112 and the agitator 114. Still further, the possibility of improper application of the force $F_2$ also may be mitigated by the fact that pressing on the pedal 138 with an excessive lateral force could cause the base 102 to move across the floor 112 away from the force. Thus, it is expected that normal operators of the foregoing embodiment will have a natural inclination to apply a generally vertical activation force $F_2$ to the pedal 138.

Figure 6:
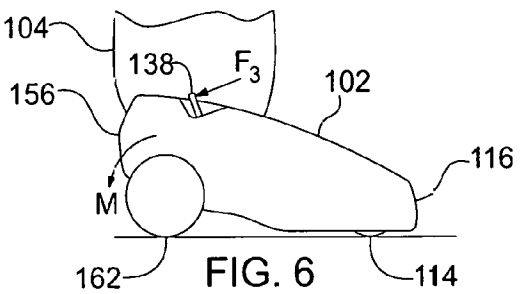
FIG. 6 is a schematic side view of another exemplary floor cleaner.

A second example is shown in FIG. 6. Here, the pedal 138 is moved to the top of the base 102, and oriented to receive a backwards horizontal activation force $F_3$. The activation force $F_3$ generates a corresponding moment force M that tends to rotate the base 102 around the rear wheel contact point 162 to lift and reduce forces applied by the agitator 114. While such a configuration is expected to be effective, it is anticipated that the application of the force $F_3$ in a horizontal direction could tend to move the base 102 across the floor 112, which could complicate the agitator cleaning operation.

Figure 7:
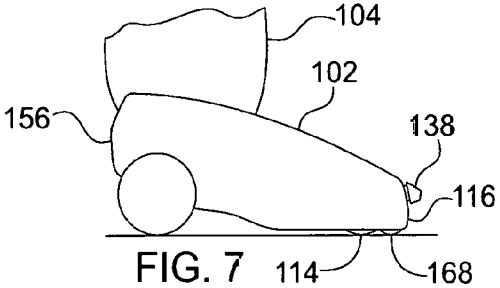
FIG. 7 is a schematic side view of another exemplary floor cleaner.

Another example is shown in FIG. 7. In this embodiment, the pedal 138 is located proximate to the front end 116 of the base 102, and the front support 160 is positioned with a front support contact point 168 located between the agitator 114 and the front end 116. The pedal's activation surface 166 is positioned forward of the front support contact point 168, so that a generally vertical downward force $F_4$ on the activation surface 166 generates a moment M that tends to lift the agitator 114 away from the floor 112.

Figure 8:
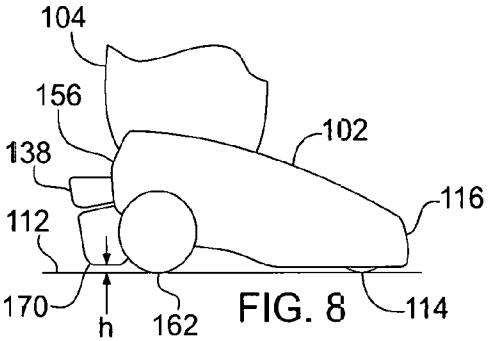
FIG. 8 is a schematic side view of another exemplary floor cleaner.

A final example is shown in FIG. 8, which is similar to the embodiment of FIG. 5. Here, the base 102 includes an anti-rotation support 170 located adjacent the back end 156 of the housing, and preferably directly below the pedal 138. The support 170 is provided to limit how far the base 102 can rotate about the rear wheel contact point 162 when the force $F_2$ is applied to the pedal 138. The desired range of rotation can be achieved by locating the lower surface of the support 170 at a height h from the floor 112 that is only sufficient to allow the desired amount of rotation before the support 170 contacts the floor 112. In a preferred embodiment, the support 170 prevents rotation more than about 15°, and an a more preferred embodiment the support 170 prevents rotation more than about 10°. Limiting the amount of rotation in this manner helps prevent the base 102 from lifting up so far that it begins to roll away as the force $F_2$ is applied, which can make operation more difficult for the user. The bottom of the support 170 may be configured to grip the underlying surface, such as by adding an overmolded or attached layer of material that has a relatively high coefficient of friction (e.g., natural or synthetic rubber) to the lower surface of the support 170, or forming ridges or other surface features into the support 107. The support 170 may comprise an extension of the housing of the base 102, or a separate part that is attached to the base 102. The support 170 also may comprise an extension that protrudes downward from the pedal 138, or other structures that inhibit rotation about the rear wheel contact point 162.

Figure 10:
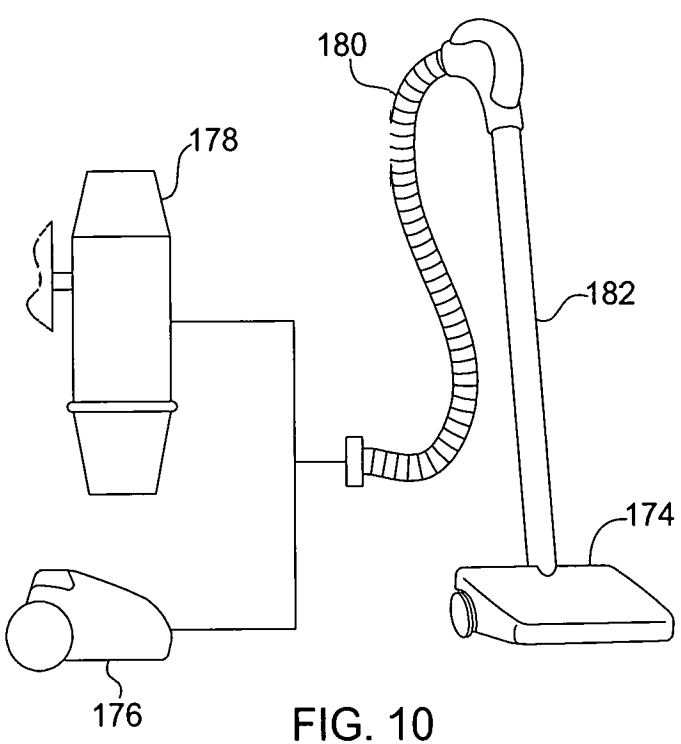
FIG. 10 illustrates a canister vacuum cleaner, central vacuum cleaner, and cleaning head that may be used with embodiments of the invention.
Figure 9:
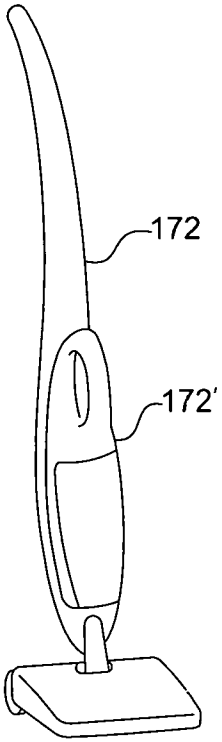
FIG. 9 illustrates a stick vacuum cleaner that may be used with embodiments of the invention.

It will be appreciated that embodiments may be implemented in any kind of vacuum cleaner or surface cleaner that uses a user-operated mechanism to activate a rotating agitator cleaning mechanism. For example, embodiments may be used in "sweeper" devices that lack a vacuum source. As another example, embodiments may be used in upright vacuum cleaners (as shown), stick vacuum cleaners 172 such as the one shown in FIG. 9 (which may include a removable handheld cleaning unit 172', as known in the art), or in vacuum cleaner cleaning heads 174 such as the one shown in FIG. 10, which can be connected to a canister vacuum cleaner 176 or a central vacuum cleaner 178 by a combination of flexible hoses 180 and rigid pipes 182 as known in the art.

The present disclosure describes a number of new, useful and nonobvious features and/or combinations of features that may be used alone or together. The embodiments described herein are all exemplary, and are not intended to limit the scope of the inventions. It will be appreciated that the features shown and described in the documents incorporated herein by reference may be added to embodiments in a manner corresponding to the use of such features in the incorporated references. It will also be appreciated that the inventions described herein can be modified and adapted in various ways, and all such modifications and adaptations are intended to be included in the scope of this disclosure and the appended claims.

We claim:

1. A vacuum cleaner head comprising:

a housing extending along a longitudinal direction from a first end of the housing to a second end of the housing;

one or more supports extending in a downward direction that is perpendicular to the longitudinal direction from the housing to a first support point located proximate to the first end of the housing;

a suction opening provided through the housing and facing in the downward direction;

an agitator chamber located above and in fluid communication with the suction opening;

an agitator comprising a spindle rotatably mounted to the housing to rotate about a rotation axis that extends through the agitator chamber, and one or more agitating devices projecting from the spindle to a first radial height;

a cleaning member movably mounted to the housing to move between a first cleaning member position in which the cleaning member does not engage the agitator, and a second cleaning member position in which the cleaning member engages the agitator to remove debris from the agitator during rotation of the agitator; and a pedal connected to the housing and movable between a first pedal position in which the pedal does not place the cleaning member in the second cleaning member position, and a second pedal position in which the pedal places the cleaning member in the second cleaning member position, the pedal having an activation surface configured to receive an activation force from an operator to move the pedal from the first pedal position to the second pedal position;

wherein the activation surface is oriented and positioned on the housing such that application of the activation force on the pedal generates a moment force to bias the agitator away from the downward direction; and wherein the pedal is operatively connected to the cleaning member by a linkage with the pedal mounted on a first pivot, and the cleaning member is mounted on a second pivot, and the linkage comprises a linear slide configured to move in a linear direction to convert a first rotational movement of the pedal about the first pivot into a second rotational movement of the cleaning member about the second pivot, via linear movement of the linear slide between the pedal and the cleaning member, to thereby move the cleaning member from the first cleaning member position to the second cleaning member position.

2. The vacuum cleaner head of claim 1, wherein the activation surface is located on a first side of the first support point in relation to the longitudinal direction, and the agitator is located on a second side of the first support point in relation to the longitudinal direction.

3. The vacuum cleaner head of claim 1, wherein the first end of the housing is a back end of the housing, the one or more supports comprise one or more rear wheels, and the second end of the housing is a front end of the housing.

4. The vacuum cleaner head of claim 3, wherein the activation surface is located behind the back end of the housing in relation to the longitudinal direction.

5. The vacuum cleaner head of claim 3, further comprising one or more front wheels extending in the downward direction from the housing, the one or more front wheels being positioned in relation to the longitudinal axis between the first support point and the agitator.

6. The vacuum cleaner head of claim 3, further comprising a handle pivot located proximate to the back end of the housing and configured to pivotally connect to a handle.

7. The vacuum cleaner head of claim 1, wherein the suction opening is located proximate to the second end of the housing.

8. The vacuum cleaner head of claim 1, wherein the first end of the housing is a front end of the housing, the one or more supports comprise one or more front wheels, and the second end of the housing is a back end of the housing.

9. The vacuum cleaner head of claim 1, further comprising an anti-rotation support located at the first end of the housing and positioned to limit how far the housing can rotate about the first support point upon application of the activation force.

10. The vacuum cleaner head of claim 9, wherein the anti-rotation support is configured to prevent the housing from rotating more than about 15° about the first support point.

11. The vacuum cleaner head of claim 9, wherein the anti-rotation support is configured to prevent the housing from rotating more than about 10° about the first support point.

12. The vacuum cleaner head of claim 1, wherein the one or more agitating devices comprise one or more rows of bristles.

13. The vacuum cleaner head of claim 1, wherein the agitator comprises one or more friction surfaces that extend to a second radial height.

14. The vacuum cleaner head of claim 13, wherein the second radial height is less than the first radial height.

15. The vacuum cleaner head of claim 13, wherein the cleaning member comprises at least one edge that extends parallel to the rotation axis and engages the one or more agitating devices and the one or more friction surfaces at the second radial height to cut debris from the agitator when the cleaning member is in the second cleaning member position.

16. The vacuum cleaner head of claim 1, wherein the linear slide comprises a cam surface configured to drive the cleaning member from the first position cleaning member position to the second cleaning member position when the pedal is moved from the first pedal position to the second pedal position.

* * * * *